US012672684B2

(12) United States Patent
Kershaw, Jr. et al.

(10) Patent No.: US 12,672,684 B2
(45) Date of Patent: Jul. 7, 2026

(54) WADER AND BIB GARMENT SYSTEM

(71) Applicants: James Robert Kershaw, Jr., Sunderland, VT (US); Kristen Elaine Chandler, Kingston, WA (US)

(72) Inventors: James Robert Kershaw, Jr., Sunderland, VT (US); Kristen Elaine Chandler, Kingston, WA (US)

(73) Assignee: Grundens USA, Ltd., Pouslbo, WA (US)

( * ) Notice: Subject to any disclaimer, the term of this patent is extended or adjusted under 35 U.S.C. 154(b) by 244 days.

(21) Appl. No.: 18/585,196

(22) Filed: Feb. 23, 2024

(65) Prior Publication Data

US 2025/0268318 A1 Aug. 28, 2025

(51) Int. Cl.

| | |
|---|---|
| ***A41D 13/02*** | (2006.01) |
| ***A41D 27/20*** | (2006.01) |
| ***A41F 15/00*** | (2006.01) |

(52) U.S. Cl.

CPC ..... *A41D 13/02* (2013.01); *A41D 27/201* (2013.01); *A41D 27/208* (2013.01); *A41F 15/00* (2013.01); *A41D 2300/32* (2013.01); *A41D 2300/322* (2013.01); *A41D 2400/00* (2013.01); *A41D 2500/50* (2013.01)

(58) Field of Classification Search

CPC ... A41D 3/06; A41D 3/00; A41D 3/02; A41D 2600/106; A41D 2600/108; A41D 13/0007; A41D 13/02; A41D 13/0012; A41D 27/208; A41D 1/04; A41D 1/02

See application file for complete search history.

(56) References Cited

U.S. PATENT DOCUMENTS

| | | | | | |
|---|---|---|---|---|---|
| 2,150,251 | A * | 3/1939 | Shanhouse | A41D 13/0012 | 2/94 |
| 2,501,111 | A * | 3/1950 | Walker | A41D 13/02 | 2/231 |
| 2,620,479 | A * | 12/1952 | Buck | A41D 13/0012 | 2/102 |
| 2,755,480 | A * | 7/1956 | Jones | A41D 13/0012 | 2/94 |
| 2,762,054 | A * | 9/1956 | Smith | A41D 13/0012 | 2/227 |

(Continued)

OTHER PUBLICATIONS

Jacket https://banded.com/products/big-stone-30-oxford-jacket.

(Continued)

*Primary Examiner* — Jillian K Pierorazio

(74) *Attorney, Agent, or Firm* — Trent Baker; BAKER IP PLLC

(57) ABSTRACT

A water-resistant lower torso and leg garment system such as a wader or bib that includes a suspension system, a set of leg regions, and a torso region. The torso region is disposed over a portion of the torso of the user such that the front, two sides, and back of the torso region correspond to the ventral, lateral, and dorsal sides of a user respectively. The torso region further includes a novel rear storage system including a proximal surface substantially disposed adjacent to the dorsal side of the user, a distal surface disposed distally from the proximal surface with respect to the user, an internal region between the proximal and distal surface, and at least one opening between the proximal and distal surface to the internal region.

20 Claims, 6 Drawing Sheets

(56) References Cited

U.S. PATENT DOCUMENTS

| | | | | |
|---|---|---|---|---|
| 3,476,102 | A * | 11/1969 | Sarnoff | A41D 13/0055 126/204 |
| 5,088,116 | A * | 2/1992 | Gould | A41D 3/06 2/121 |
| 6,317,893 | B1 * | 11/2001 | Walton | A41D 27/04 2/82 |
| 6,772,440 | B1 * | 8/2004 | Foster | A41D 13/02 2/82 |
| 9,271,533 | B2 * | 3/2016 | Kochling | A41D 27/205 |
| 10,178,883 | B2 * | 1/2019 | Bonime | A41D 13/012 |
| 2004/0187185 | A1 * | 9/2004 | David | A41D 13/02 2/69 |
| 2004/0237169 | A1 * | 12/2004 | Wood | A41D 13/0012 2/94 |
| 2010/0132089 | A1 * | 6/2010 | Myers | A41D 13/012 2/87 |
| 2010/0306897 | A1 * | 12/2010 | Wood | A41F 15/002 2/82 |
| 2013/0061367 | A1 * | 3/2013 | Garneau | A41D 13/0015 2/85 |
| 2013/0205465 | A1 * | 8/2013 | McClintock | A41D 13/02 2/82 |
| 2016/0331052 | A1 * | 11/2016 | West | A41D 27/02 |
| 2017/0095022 | A1 * | 4/2017 | Hollimon | A41D 27/201 |
| 2017/0295872 | A1 * | 10/2017 | Messner | A41D 27/04 |
| 2017/0347729 | A1 * | 12/2017 | Goff | A41D 27/20 |
| 2018/0116311 | A1 * | 5/2018 | Callison | A41D 27/20 |
| 2018/0271193 | A1 * | 9/2018 | Aitch | A41D 31/185 |
| 2019/0098948 | A1 * | 4/2019 | Studinger | A41D 1/02 |
| 2019/0104775 | A1 * | 4/2019 | Wood | A41D 3/00 |
| 2019/0200739 | A1 * | 7/2019 | Green Mullins | A41D 13/0012 |
| 2019/0373968 | A1 * | 12/2019 | Thatcher | A41D 13/0015 |
| 2019/0380409 | A1 * | 12/2019 | Clark | A44B 11/266 |
| 2020/0121000 | A1 * | 4/2020 | Wood | A41D 13/012 |
| 2021/0052022 | A1 * | 2/2021 | George | A41D 27/24 |
| 2021/0161222 | A1 * | 6/2021 | Krull | A41D 31/102 |
| 2022/0225697 | A1 * | 7/2022 | Krull | A41D 27/20 |
| 2022/0304401 | A1 * | 9/2022 | Nelson | A41D 31/102 |
| 2023/0119312 | A1 * | 4/2023 | Norris, Jr. | A41D 27/201 2/79 |
| 2023/0248086 | A1 * | 8/2023 | Tyson | A41D 13/02 2/79 |
| 2025/0268317 | A1 * | 8/2025 | Chaney | A41D 13/02 |

OTHER PUBLICATIONS https://www.llbean.com/llb/shop/120890?page=tek-upland-waterproof-jacket-color-block-mens-regular&bc=&feat=tek-SR0&csp=a&attrValue_0=31174&searchTerm=tek&pos=9.
https://www.llbean.com/llb/shop/128460?page=upland-hunting-vest-mens&bc=&feat=vest-SR0&csp=a&attrValue_0=35340&searchTerm=vest&pos=15.
https://www.llbean.com/llb/shop/122741?page=double-l-waxed-upland-vest-mens-regular&bc=&feat=vest-SR0&csp=a&attrValue_0=35080&searchTerm=vest&pos=13.
https://arrakusa.com/collections/men-outdoor-jackets/products/new-waterproof-original-winter-jacket-jacket-men-burnt-orange.
https://www.cabelas.com/shop/en/cabelas-instinct-prairie-runner-upland-coat-for-men-with-4most-dryplus-and-4most-repel.
https://longmeadoweventcenter.com/product/orvis-tough-shell-upland-waterproof-jacket/.
https://www.columbia.com/p/mens-phg-ptarmigan-interchange-parka-1644291.html.
https://www.simmsfishing.com/products/womens-g3-guide-jacket.
https://www.cabelas.com/shop/en/cabelas-upland-traditions-vest-for-men.
https://www.beretta.com/en-us/product/beretta-covey-retriever-vest-GU563T1651.
https://www.gamehide.com/products/fenceline-weatherproof-upland-field-hunting-jacket.
https://www.gamehide.com/products/shelterbelt-upland-jacket.
https://www.simmsfishing.com/products/guide-vest-s18.
https://www.simmsfishing.com/products/freestone-vest-2.
https://www.orvis.com/product/orvis-pro-vest/2MXC.html.
https://www.columbia.com/p/mens-pfg-henrys-fork-v-vest-1470961.html.
https://www.llbean.com/llb/shop/127972?page=llbean-rapid-river-vest-pack-ii.
https://www.patagonia.com/product/stealth-pack-fly-fishing-vest/81962.html.

* cited by examiner

WADER AND BIB GARMENT SYSTEM

FIELD OF THE INVENTION

The invention generally relates to improved wader and bib garment systems. In particular, the present invention relates to a water-resistant lower torso and leg garment system configured to be worn by a user over a portion of their torso and leg regions.

BACKGROUND OF THE INVENTION

Waders and bibs are garments used by outdoor enthusiasts to minimize moisture on the lower torso and leg regions of a user. Waders and bibs both include two leg regions, a torso region, and a suspension system. A wader further includes two foot regions that creates a watertight system to keep water out or retention on the feet of the user. The leg regions, torso region, and foot regions are intercoupled to maintain water resistance across and between these areas of a user. The suspension system supports the wader or bib on the user so as to maintain optimal anatomical positioning.

Waders and bibs are commonly used for leisure activities including angling, gardening, hunting, off-roading. Waders and bibs may also be used during work related activities that involve water or chemicals. Waders and bibs work to prevent the external moisture from directly transferring to the user through water resistant materials such as rubber, PVC, PU, and neoprene, or waterproof breathable fabrics including a membrane or coating. However, condensation and other types of moisture may still contact the user during use.

Conventional waders and bibs may further include ventral or frontal storage systems such as pockets. The purpose of these storage systems is to allow the user to store and protect items for use during a particular activity. For example, a user may store a cell phone or watch which must be protected from external moisture. A user may also store additional tools for their activity such as fishing lures, tackle boxes, hooks, line, etc. The frontal storage systems are generally located on the torso region of the wader or bib to allow convenient access even during partial submersion.

Conventional wader and bib storage systems suffer from multiple problems, including capacity and obstruction. The frontal portion of the torso region contains limited size and therefore limited amount of space within which storage systems may be disposed. In addition, the storage of any larger items will cause protrusion of the storage system, which will likely obstruct the user's joint articulation. For example, if the user stores a larger item in the storage system such as a jacket, the volume of the jacket will cause the frontal region to protrude distally and thereby impede the articulation of the user's arm during certain arm activities.

Therefore, there is a need in the industry for an improved wader and bib storage system that simultaneously provides sufficient capacity of storage without obstruction.

SUMMARY OF THE INVENTION

The present invention relates to wader and bib systems. One embodiment of the present invention relates to a water-resistant lower torso and leg garment system configured to be worn by a user over a portion of their torso and leg regions. The system includes a suspension system, a set of leg regions, and a torso region intercoupled between and to both the set of leg regions and the suspension system. The torso region is disposed over a portion of the torso of the user such that the front, two sides, and back of the torso region correspond to the ventral, lateral, and dorsal sides of a user, respectively. The torso region further includes a novel rear storage system including a proximal surface substantially disposed adjacent to the dorsal side of the user, a distal surface disposed distally from the proximal surface with respect to the user, an internal region between the proximal and distal surface, and at least one opening between the proximal and distal surface to the internal region. The rear storage system may further include a water-resistant closure system over the at least one opening.

Embodiments of the present invention represent a significant advancement in the field of waders and bibs. Prior art waders and bibs failed to provide optimal storage that both maximized capacity and prevented obstruction of the user. Embodiments of the present invention include a novel rear storage system that allows the user to store large items without obstructing their frontal region. For example, a user may efficiently store large items in a rear lumbar region that extend away from the user without obstructing their frontal region.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

The present invention relates to wader and bib systems. One embodiment of the present invention relates to a water-resistant lower torso and leg garment system configured to be worn by a user over a portion of their torso and leg regions. The system includes a suspension system, a set of leg regions, and a torso region intercoupled between and to both the set of leg regions and the suspension system. The torso region is disposed over a portion of the torso of the user such that the front, two sides, and back of the torso region correspond to the ventral, lateral, and dorsal sides of a user respectively. The torso region further includes a novel rear storage system including a proximal surface substantially disposed adjacent to the dorsal side of the user, a distal surface disposed distally from the proximal surface with respect to the user, an internal region between the proximal and distal surface, and at least one opening between the proximal and distal surface to the internal region. The rear storage system may further include a water-resistant closure system over at least one opening. Also, while embodiments are described in reference to waders and bibs, it will be appreciated that the teachings of the present invention are applicable to other areas, including but not limited to supporting other lower body garments.

Definitions

Water-resistant lower torso and leg garment system—a garment which may be worn over at least a portion of the user's torso and legs. The system may further include portions that extend over the user's feet. The terms wader or bib may fall under the scope of a water-resistant lower torso and leg garment system, since both types of garments extend over a portion of a user's torso and legs. The system may include one or more water-resistant materials, including but not limited to rubber, neoprene, PVC, PU, and waterproof breathable fabrics including a membrane or coating.

Figure 1A:
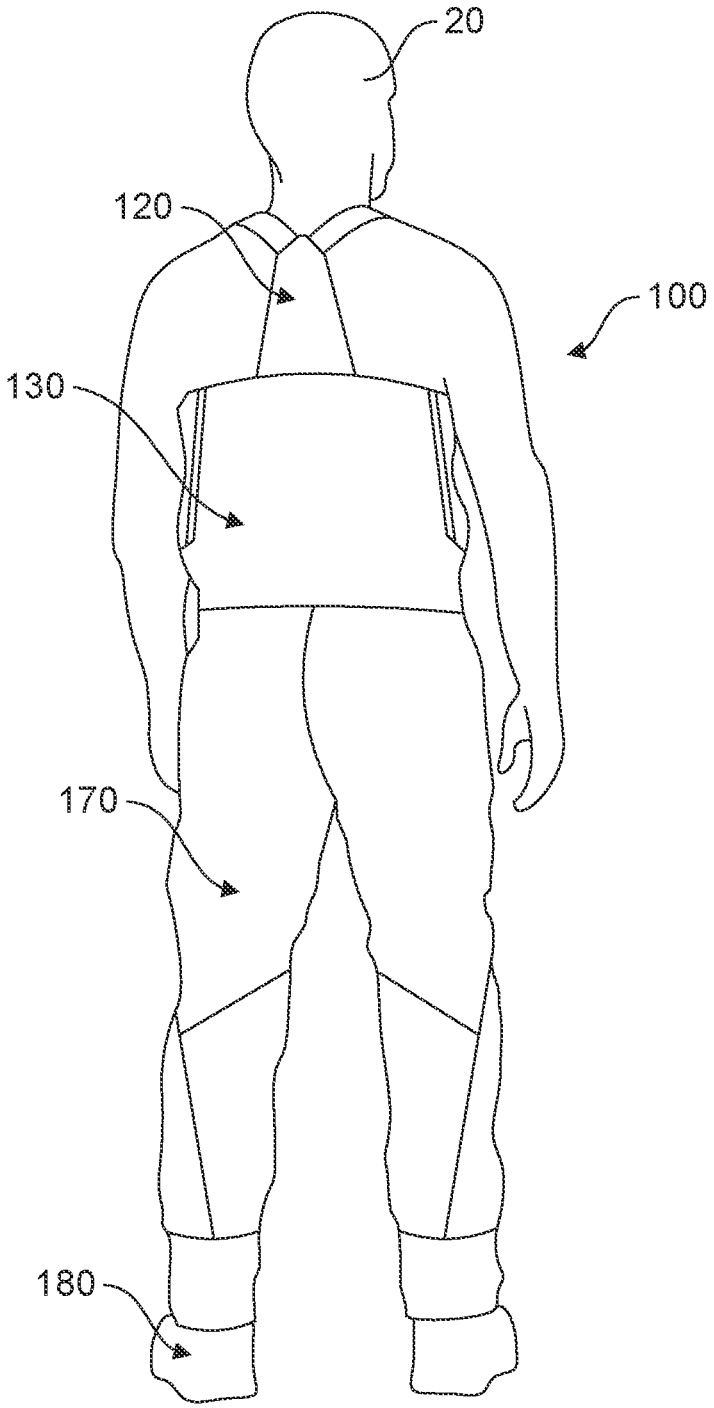
FIG. 1A illustrates a rear schematic view of a garment system on a user accordance with embodiments of the present invention.

Reference is initially made to FIG. 1A, which illustrates a water-resistant lower torso and leg garment system, designated generally at 100. The illustrated system 100 includes a suspension system 120, a torso region 130, a leg region 170, and an optional foot region 180. The illustrated garment system 100 is a fishing wader, but it will be appreciated that teachings may be applied to other lower body garments such as a bib without a foot region 180. FIG. 1A illustrates a rear view of the system 100 disposed on a user 20.

The illustrated suspension system 120 further includes a set of shoulder straps 124 and a back strap 122. It will be appreciated that various types of suspension systems may be utilized with embodiments of the present invention, such as using only shoulder straps or other harnessing systems. The shoulder straps 124 attach to the front of the torso region 130 of the system on one end and the back strap 122 on the other end. Likewise, the back strap 122 attaches to the back of the torso region 130 on one end and the shoulder straps 124 on the other end. The shoulder straps 124 extend over each of the user's shoulders to effectively suspend and support the remainder of the system 100 on the user. The shoulder straps 124 are ideally adjustable to accommodate various body sizes. The back strap 122 is located in proximity to the thoracic region of the user's back to distribute load from the shoulder straps 124. The shoulder straps 124 may be composed of an elastic material to enable expansion during use.

The leg regions 170 and foot regions 180 are disposed over the user's 20 feet respectively. The leg and foot regions 170, 180 may be composed of a water-resistant material to prevent or minimize moisture from contacting the user. It will be appreciated that condensation or perspiration may form within the region between the user 20 and the garment 100. The leg and foot regions 170, 180 are intercoupled with one another as shown and may be constructed integrally as part of the overall system 100. Various manufacturing processes may be utilized to construct the system 100 without requiring manufacturing and coupling the individual region such as a single mold.

The torso region 130 is disposed over a portion of the torso of the user 20 such that the front 166, two sides 160, and back of the torso region 130 correspond to the anatomical ventral, lateral, and dorsal sides of the user 20, respectively. The torso region 130 is substantially cylindrically shaped with a top opening and a bottom opening coupled to the leg regions 170. The front 160 of the torso region 130 will be described in more detail with reference to FIG. 4A below.

Figure 1B:
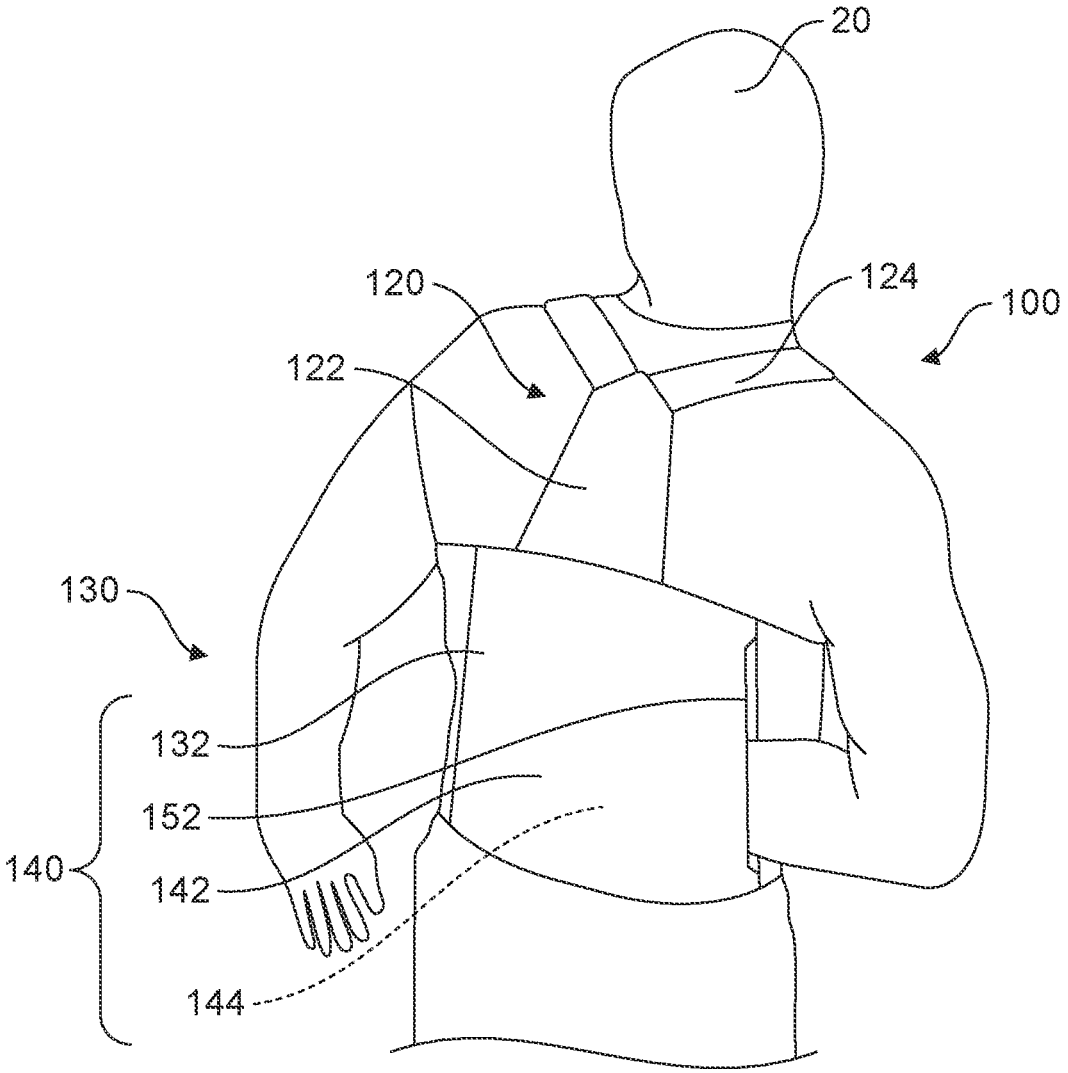
FIG. 1B illustrates a detailed schematic view of the rear storage system on a user in accordance with the embodiment illustrated in FIG. 1A.
Figure 1C:
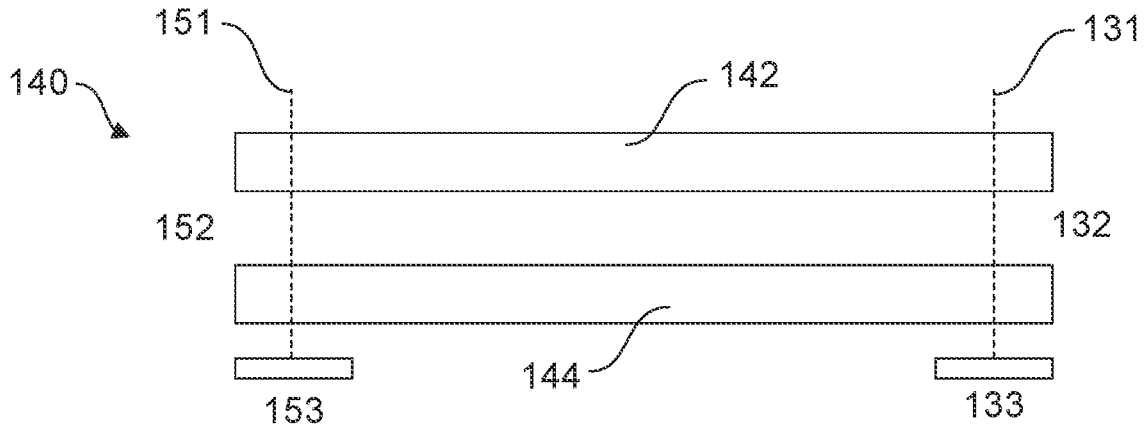
FIG. 1C illustrates a cross-sectional detailed view of the rear storage system illustrated in FIGS. 1A-B.
Figure 1D:
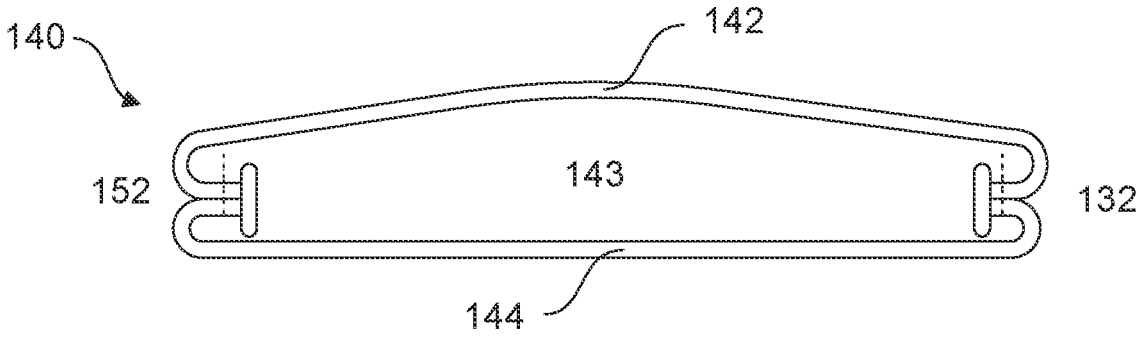
FIG. 1D illustrates an alternative cross-sectional detailed view of the rear storage system illustrated in FIGS. 1A-B.
Figure 2C:
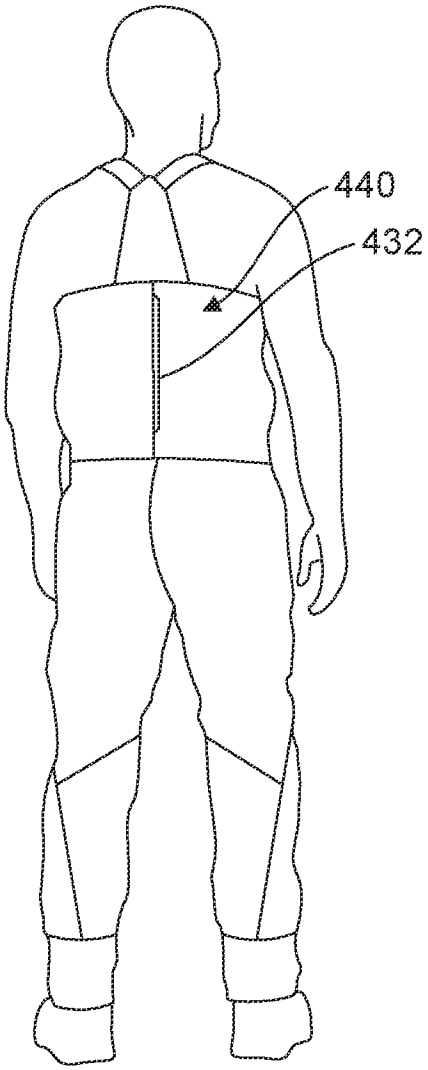
FIGS. 2A-C illustrate rear schematic views of a garment system on a user in accordance with alternative embodiments.
Figure 2B:
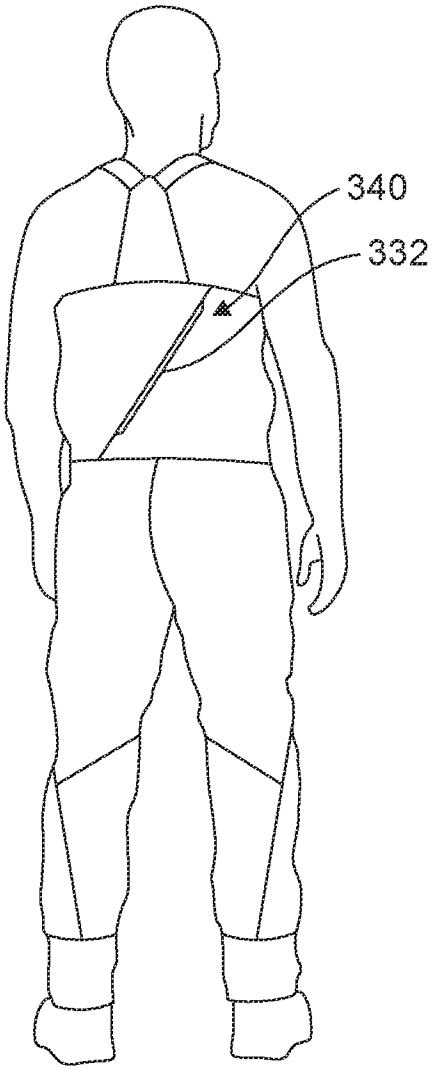
Figure 2A:
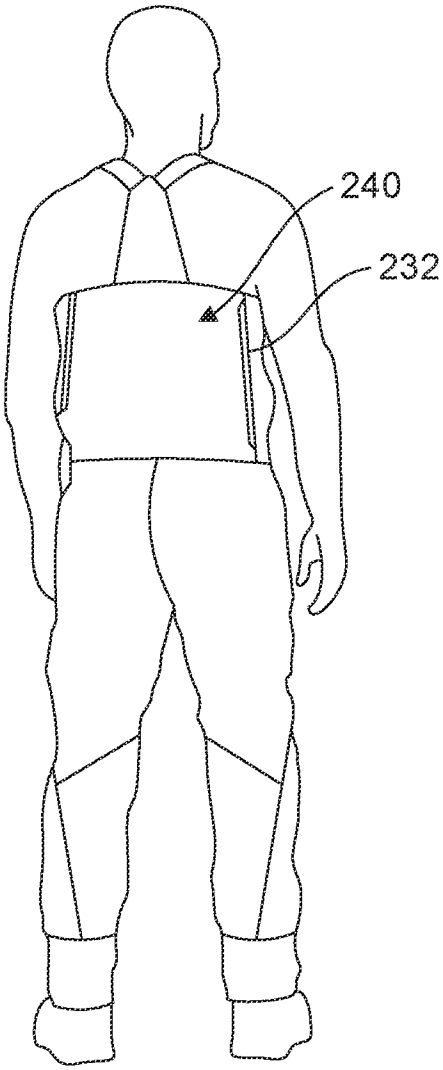

The torso region 130 further includes a novel rear storage system, designated generally at 140 and shown in more detail in FIG. 1B. The illustrated rear storage system 140 includes a proximal surface 144 and a distal surface 142 with an internal region 143 therebetween. The proximal surface 144 is disposed substantially adjacent to the user 20. The distal surface 142 may be larger than the proximal surface 144 such that the internal region 143 has a non-rectangular or trapezoidal shape as shown in FIGS. 1C-D. The non-rectangular shape of the internal region 143 is optimal for maximizing storage capacity while maintaining a substantially continuous outer surface. For example, the shape of the internal region 143 allows for an effectively expandable outer dimension to accommodate different sized items. The illustrated rear storage system 140 further includes a first and second opening 132, 152 located on either side of the back of the torso region 130 adjacent to the sides 160 of the torso region 130. The first and second openings 132, 152 allow for selective user access to the internal region 143. It will be appreciated that only one opening is necessary in accordance with other embodiments of the invention as shown in FIGS. 2A-C. In addition, the optimal orientation or angle of the first and second opening 132, 152 will also be described in more detail with reference to FIG. 4A. The illustrated rear storage system 140 further includes a first and second closure system 131, 151 over the first and second openings 132, 152 respectively. The first and second closure systems 131, 151 allow a user to selectively access the internal region 143 yet protect the internal region 143 from moisture when not accessing. The first and second closure systems 131, 151 may include any water-resistant closure systems such as a zipper, hook and loop, etc. The illustrated first and second openings 132, 152 are also covered by a flap of distal surface 142 such that even without the first and second closure systems 131, 151, the first and second openings 132, 152 are somewhat protected from allowing moisture to enter the internal region 143.

FIG. 1C illustrates a cross-sectional view of the rear storage system 140 illustrated in FIG. 1A-B. It will be appreciated that the proximal and distal surfaces 144, 142 may be composed of multiple layers of material to provide additional functionality such as rigidity, insulation, and increased water resistance. FIG. 1C also illustrates that the first and second closure systems 131, 151 include first and second seam tape 133, 153 to further protect the internal region 143 from moisture and maintain overall durability. FIG. 1D also illustrates a cross-sectional view of the rear storage system 140 illustrating the non-rectangular shape of the internal region 143.

FIGS. 2A-C illustrate three alternative embodiments of the rear storage system, designated at 240, 340, and 440. The three illustrated alternative rear storage systems 240, 340, 440 includes a single opening 232, 332, 432 to the internal region. It may be advantageous to utilize a single opening to the internal region to further protect the internal region from moisture or simplify the manufacturing process. The first alternative embodiment shown in FIG. 2A includes a single substantially vertical opening on the illustrated right side of the torso region. The second alternative embodiment shown in FIG. 2B includes a single, tilted, 45-degree opening in the middle of the back of the torso region. The middle of the back of the torso region may also be defined as substantially equidistant between the two sides of the torso region. The third alternative embodiment shown in FIG. 2C includes a single opening in the middle of the back of the torso region.

Figure 3A:
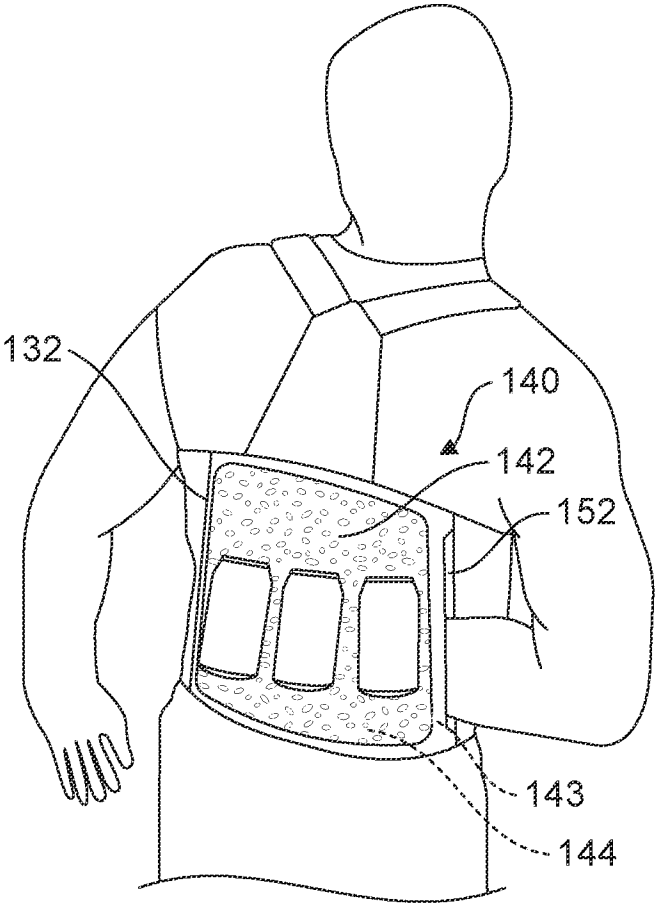
FIG. 3A-B illustrate detailed operational schematic views of the rear storage system in accordance with the embodiment illustrated in FIG. 1.
Figure 3B:
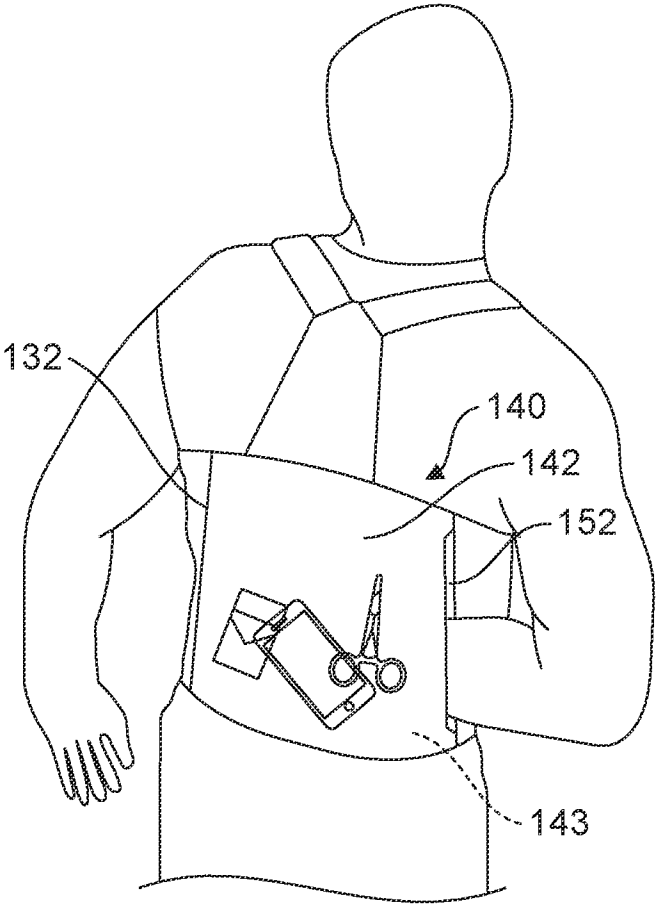

FIGS. 3A and 3B illustrate two operational views of the rear storage system 140 shown in FIGS. 1A-B. The embodiment shown in FIG. 3A further includes an insulated member 146 disposed adjacent to the proximal surface 144 within the internal region 143. The insulated member 146 may be coupled to the proximal surface 144 within the internal region 143. The insulated member 146 may be composed of any insulating material such as foam, silicone, fleece, wool, etc. The insulated member 146 substantially thermally isolates the internal region 143 from the user 20 to allow for items to maintain an independent temperature. For example, FIG. 3A illustrates the storage of three aluminum cans of liquid within the internal region 143 distal to the insulating member 146. Therefore, the insulating member 146 will reduce or minimize the user's body temperature from affecting the cans of liquid. Likewise, the user's body temperature will not be undesirably affected by the cans of liquid. FIG. 3B also illustrates an operational view of the internal region 143 storing various items. The proximal and distal surfaces 144, 144 within the internal region 143 may also include puncture-resistant materials to prevent stored items from puncturing either surface.

Figure 4C:
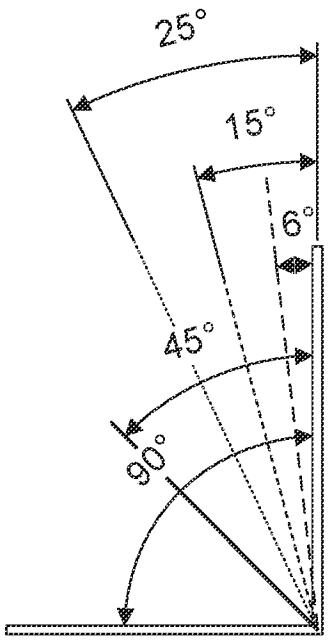
FIG. 4C illustrates a set of optimal angles at which the first and second opening of the rear storage system may be oriented.
Figure 4B:
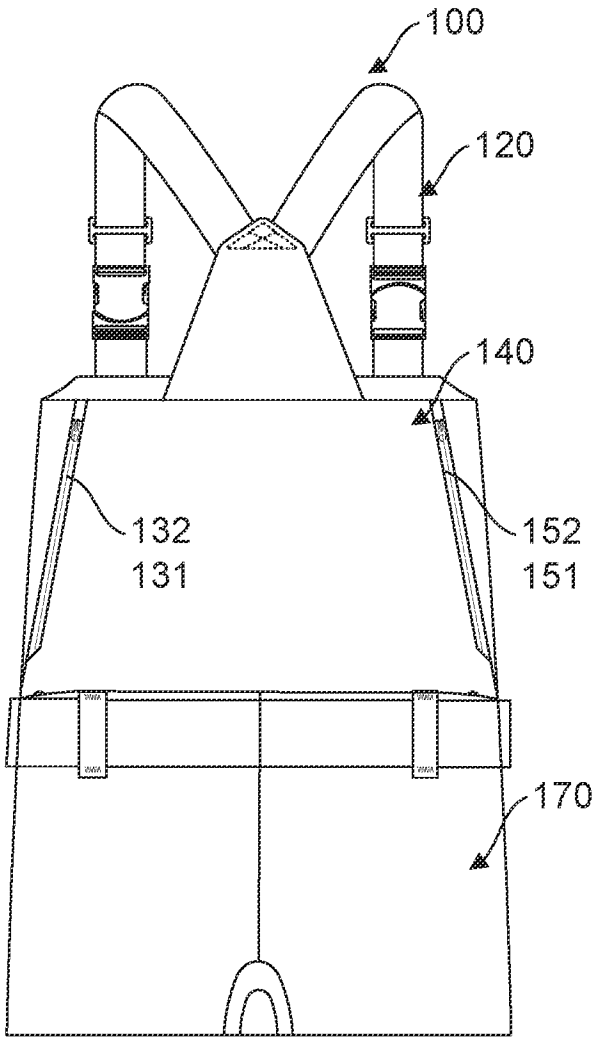
FIG. 4A-B illustrate front and rear schematic views of the garment system in accordance with the embodiment illustrated in FIG. 1A.
Figure 4A:
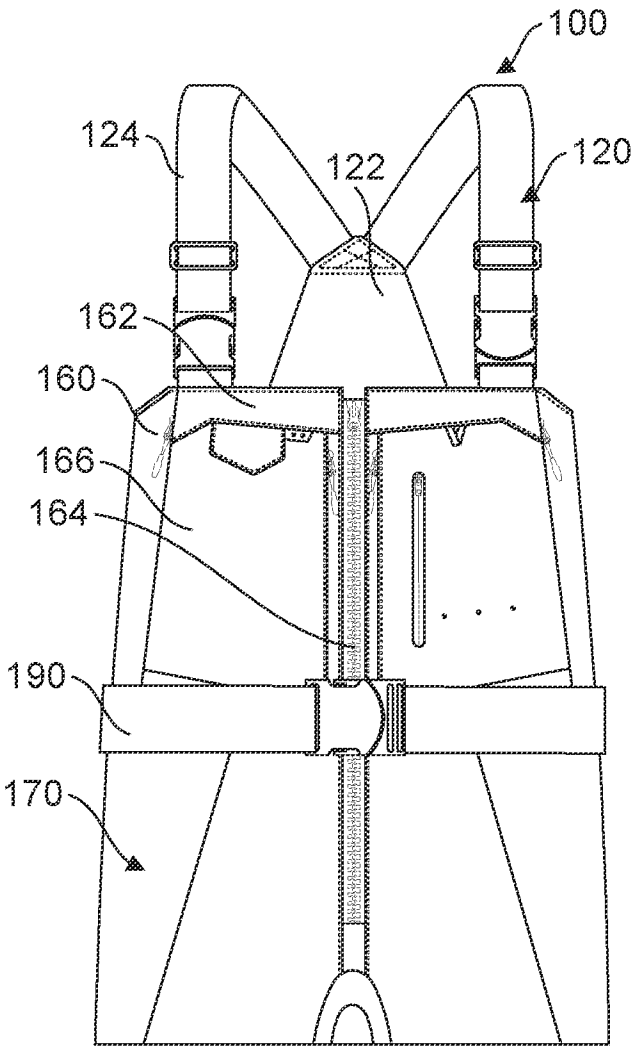

FIGS. 4A and 4B illustrate front and rear views of the system 100 shown in FIG. 1A-B. FIG. 4A illustrates the front side 162 of the torso region 130 of the system 100. A conventional front storage system 166 may be located on the front side 162 of the torso region 130. As discussed above, the front storage 166 can be limited in size to prevent obstruction during use. For example, any protrusion of the front storage 166 may impede the user's arm dexterity during use. The front side 162 of the torso region 130 also includes an illustrated torso zipper 164 to facilitate taking the system on and off the user 20. A belt 190 may also extend around the waist portion of the system 100 between the torso region 130 and leg regions 170 to further support the system 100 on the user 20.

FIG. 4B illustrates the back side of the torso region 130 with a first and second opening 132, 152 and first and second closure system 131, 151. The openings 132, 152 and closure systems 131, 151 are angled toward the sagittal plane (middle) of the user at the top, thereby defining an angle at the bottom. The angling or tilting of the openings 132, 152 and closure systems 131, 151 increases ergonomic access for the user 20 in correspondence to the operation of the user's shoulder joint. FIG. 4C illustrates the optimal angles for the openings 132, 152 and closure systems 131, 151. The optimal angle is between 0 (vertical) and 25 degrees toward the center.

It should be noted that various alternative system designs may be practiced in accordance with the present invention, including one or more portions or concepts of the embodiment illustrated in FIG. 1 or described above. Various other embodiments have been contemplated, including combinations in whole or in part of the embodiments described above.

What is claimed is:

1. A water-resistant lower torso and leg garment system configured to be worn by a user over a portion of their torso and leg regions comprising:

a suspension system configured to support the garment on the user;

a set of leg regions shaped to correspond to the legs of the user;

a torso region intercoupled between and to both the set of leg regions and the suspension system, wherein the torso region is disposed over a portion of the torso of the user, and wherein the torso region further includes a front, two sides, and a back corresponding to the ventral, lateral, and dorsal sides of a user respectively;

a rear storage system disposed on the back of the torso region comprising:

a proximal surface substantially disposed adjacent to the dorsal side of the user;

a distal surface disposed distally from the proximal surface with respect to the user;

an internal region between the proximal and distal surface;

at least one opening between the proximal and distal surface to the internal region; and wherein the rear storage system is integrally constructed with the torso region and the set of leg regions as part of the overall garment system to maintain water resistance without separate coupling.

2. The system of claim 1, wherein the system further extends over the feet of the user and includes a set of feet regions coupled to the set of leg regions.

3. The system of claim 1, wherein the leg regions and torso region are composed of at least one of a water-resistant material including at least one of rubber, PVC, neoprene, PU, and a waterproof breathable fabric including at least one of a membrane and coating.

4. The system of claim 1, wherein the suspension system further includes a set of shoulder straps.

5. The system of claim 1, wherein the rear storage system further includes at least one water resistant closure system over the at least one opening including at least one of a zipper and hook and loop.

6. The system of claim 1, wherein the at least one opening includes a first opening and a second opening, and wherein the rear storage system includes a first and second water resistant closure system over the first and second openings respectively each including at least one of a zipper and hook and loop.

7. The system of claim 1, wherein the rear storage system further includes an insulating member disposed within the internal region.

8. The system of claim 1, wherein the internal region of the rear storage system includes a non-rectangular shape.

9. The system of claim 1, wherein the proximal and distal surfaces are stitched and taped to one another so as to form the internal region therebetween.

10. The system of claim 1, wherein the proximal and distal surfaces include multiple layers of material.

11. The system of claim 1, wherein the internal region is disposed adjacent to a lumbar region of the dorsal side of the user.

12. The system of claim 1, wherein the at least one opening includes a first and second opening, and wherein the rear storage system includes a first closure system over the first opening and a second closure system over the second opening, and wherein the first and second opening are angled between vertical and 25 degrees off vertical toward the middle of the user.

13. The system of claim 1, wherein the rear storage system further includes a water resistant closure system over the at least one opening, and wherein the at least one opening and closure system are disposed substantially equidistantly between the sides of the torso region.

14. The system of claim 13, wherein the at least one opening and closure system are oriented vertically in substantial alignment with the user.

15. The system of claim 13, wherein the at least one opening and closure system are oriented at an approximate 45 degree angle.

16. The system of claim 1, wherein garment system further includes a front storage system disposed on the front of the torso region.

17. The system of claim 1, wherein the garment system includes a zipper disposed on the front of the torso region.

18. The system of claim 1, wherein the garment system further includes a belt disposed between the leg regions and the torso region.

19. A water-resistant lower torso and leg garment system configured to be worn by a user over a portion of their torso and leg regions comprising:

a suspension system configured to support the garment on the user;

a set of leg regions shaped to correspond to the legs of the user;

a torso region intercoupled between and to both the set of leg regions and the suspension system, wherein the torso region is disposed over a portion of the torso of the user, and wherein the torso region further includes a front, two sides, and a back corresponding to the ventral, lateral, and dorsal sides of a user respectively;

a set of feet regions shaped to correspond to the feet of the user;

a rear storage system disposed on the back of the torso region comprising:

a proximal surface substantially disposed adjacent to the dorsal side of the user;

a distal surface disposed distally from the proximal surface with respect to the user;

an internal region between the proximal and distal surface;

at least one opening between the proximal and distal surface to the internal region; and wherein the rear storage system is integrally constructed with the torso region and the set of leg regions as part of the overall garment system to maintain water resistance without separate coupling.

20. A water-resistant lower torso and leg garment system configured to be worn by a user over a portion of their torso and leg regions comprising:

a suspension system configured to support the garment on the user;

a set of leg regions shaped to correspond to the legs of the user;

a torso region intercoupled between and to both the set of leg regions and the suspension system, wherein the torso region is disposed over a portion of the torso of the user, and wherein the torso region further includes a front, two sides, and a back corresponding to the ventral, lateral, and dorsal sides of a user respectively;

wherein the leg regions and torso regions are composed of at least one of a water-resistant material including at least one of rubber, PVC, neoprene, PU, and a waterproof breathable fabric including at least one of a membrane and coating;

a rear storage system disposed on the back of the torso region comprising:

a proximal surface substantially disposed adjacent to the dorsal side of the user;

a distal surface disposed distally from the proximal surface with respect to the user;

an internal region between the proximal and distal surface;

at least one opening between the proximal and distal surface to the internal region; and wherein the rear storage system is integrally constructed with the torso region and the set of leg regions as part of the overall garment system to maintain water resistance without separate coupling.

* * * * *